United States Patent [19]

Kypke et al.

[11] Patent Number: 4,662,788

[45] Date of Patent: May 5, 1987

[54] OFFSHORE PLATFORM LEG-MATING APPARATUS AND A METHOD OF ASSEMBLY

[75] Inventors: Dean A. Kypke, Sugar Land, Tex.; Philip R. Hawley, Crowthorne, England; Thomas N. Britton, II, Houston, Tex.; George J. White, Harrow, England

[73] Assignee: Conoco Inc., Ponca City, Okla.

[21] Appl. No.: 825,183

[22] Filed: Jan. 31, 1986

[30] Foreign Application Priority Data

Feb. 1, 1985 [GB] United Kingdom ..... 8502600
Sep. 17, 1985 [GB] United Kingdom ..... 8522975

[51] Int. Cl.[4] ..... E02D 25/00

[52] U.S. Cl. ..... 405/204; 405/203; 405/195

[58] Field of Search ..... 405/203, 204, 205, 206, 405/207, 208, 209, 195; 114/264, 265

[56] References Cited

U.S. PATENT DOCUMENTS 4,252,469 2/1981 Blight et al. ..... 405/204
4,413,926 11/1983 Ninet ..... 405/204
4,436,454 3/1984 Ninet et al. ..... 405/204

*Primary Examiner*—Dennis L. Taylor
*Attorney, Agent, or Firm*—Richard K. Thomson

[57] ABSTRACT

A leg mating system for aligning a pre-constructed deck portion with a previously situated base portion of an offshore platform. The deck portion is supported upon a barge and brought into position above the base. A plurality of stabbing pins are hydraulically extended from the legs of the deck portion and are received in capture members in the legs of the base portion. A first spring having a first spring rate and a second spring having a second spring rate higher than the first, are operative in that order to resiliently oppose reduction of the separation between the deck and base portions with a spring rate which increases as the separation decreases. The capture members are capable of accommodating axial misalignment between the legs of the deck and base portions of up to five degrees.

20 Claims, 11 Drawing Figures

OFFSHORE PLATFORM LEG-MATING APPARATUS AND A METHOD OF ASSEMBLY

BACKGROUND AND SUMMARY OF THE INVENTION

The present invention relates to offshore platforms and, especially, to the assembly of an offshore platform by mating a pre-constructed integral deck portion being carried by a barge, or the like, onto a jacket portion that is already positioned with its base secured to the bed of a sea or other body of water and its top at, or slightly above, water level. Throughout this specification, the term "jacket portion" is used without limitation as to the material or manner of construction of the jacket portion.

The invention is especially applicable where the jacket portion is standing secured to the sea bed, or the like, in comparatively deep water or is floating with its top at, or slightly above, water level, and a deck portion in the form of a pre-constructed integrated deck structure is to be lowered onto it from a barge, or the like.

Viewed from one aspect, the present invention provides a combination of a deck portion and a base portion for an offshore platform, including one or more mating devices, each of which comprises an extendable stabbing pin mounted on one of said portions and a capture member for said stabbing pin mounted on the other of said portions, and resilient means associated with each of said mating devices and arranged to oppose a reduction in the separation of the said portions following operation of its associated mating device, the said resilient means of a first one of said mating devices having a smaller spring rate than that of a second resilient means mounted on the same or a different mating device, and the first and second resilient means being arranged to become effective in that order upon operation of the said mating device(s), whereby the said reduction in the separation of the said portions upon operation of the mating device(s) is opposed by the said resilient means with a spring rate which increases as the separation decreases.

In a first embodiment, each of the tubular leg members has the leg mating system described above comprising a first soft spring means and a second harder spring means. In an alternate embodiment, the four corner leg members contain the soft spring means, while some or each of the intermediate leg members contain the harder spring means.

Viewed from another aspect, the invention provides a method of assembling an offshore platform by mating a deck portion to a base portion, which comprises operating a plurality of mating devices by, in each case, extending a stabbing pin from one of said portions to engage a capture member on the other of said portions, and reducing the separation between the said portions against forces exerted by resilient means associated with each of said mating devices, the spring rate of the said resilient means of a first one of said devices being smaller than that of a second resilient means mounted on the same or on a second such device, the first and second resilient means being arranged to become effective in that order upon operation of the said mating devices, whereby the said reduction in the separation of the said portions upon operation of the mating devices is opposed by the said resilient means with a spring rate which increases as the separation decreases.

In the above-mentioned second embodiment, a plurality of mating devices with said first spring rate, preferably the corner legs, and a separate plurality of mating devices with said second spring rate, preferably the intermediate legs, are provided. In operation, all of the first mating devices will then be operated (not necessarily simultaneously) before any of the second mating devices are operated.

Viewed from a further aspect, the invention provides a combination of a deck portion and a base portion for an offshore platform, including a plurality of mating devices each of which comprises an extendable stabbing pin mounted on one of the said portions and a capture member for said stabbing pin mounted on the other of the said portions, and resilient means in said mating devices arranged, during operation of said devices, to oppose a reduction in the separation of the said portions with a total spring rate that is greater at small separations than at large separations.

Viewed from yet another aspect, the invention provides a method of assembling an offshore platform by mating a deck portion to a base portion, which comprises operating a plurality of mating devices by extending stabbing pins from one of said portions to engage respective capture members on the other of said portions, and reducing the separation between the deck portion and the base portion against a force exerted by resilient means associated with said mating devices, the total spring rate of the said resilient means being greater at small separations than at large separations.

With suitable arrangement of the mating devices the stabbing pins can be extended into engagement with their capture members and then serve to guide the deck portion into correct mating alignment as it is lowered onto the base portion, while the increasing spring rate of the said resilient means ensures a smooth transfer of the weight of the deck portion from the barge onto the base portion.

Preferably the stabbing pins are mounted on the deck portion and the capture members on the base portion.

A distal end portion of each stabbing pin and a corresponding portion of its associated capture member may be so shaped as to tend to produce a self-centering action. The distal end portion of the stabbing pin is advantageously convex and the corresponding portion of the capture member concave, and they preferably have conical surfaces.

The said deck portion and base portion may include tubular leg members that are arranged to abut end to end when the said portions are fully mated, and each said mating device is then advantageously disposed within a said leg member of the base portion and the corresponding leg member of the deck portion. Preferably, when the stabbing pin is retracted the mating device lies completely within the space envelope of the two legs, where it will neither be exposed to accidental damage nor obstruct other operations carried out within the vicinity of either the deck portion or the base portion.

The invention also provides a platform assembled from a combination of a deck portion and a base portion according to the invention and/or by a method according to the invention.

The invention further provides a mating device for a combination according to the invention, and a set of parts of such a mating device.

Various other features, characteristics and advantages of the present invention will become apparent after a reading of the following specification.

DETAILED DESCRIPTION OF THE PREFERRED EMBODIMENTS

Figure 1:
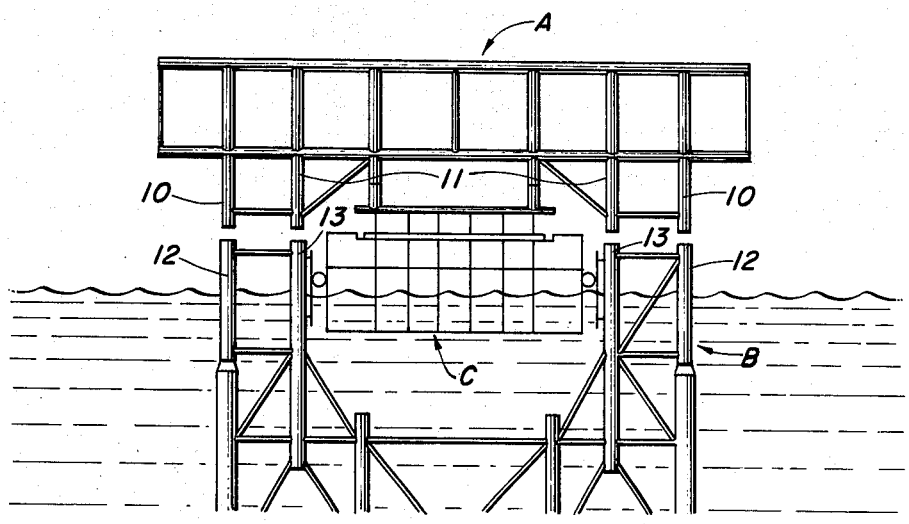
FIG. 1 is a schematic view of the platform during assembly.
Figure 2:
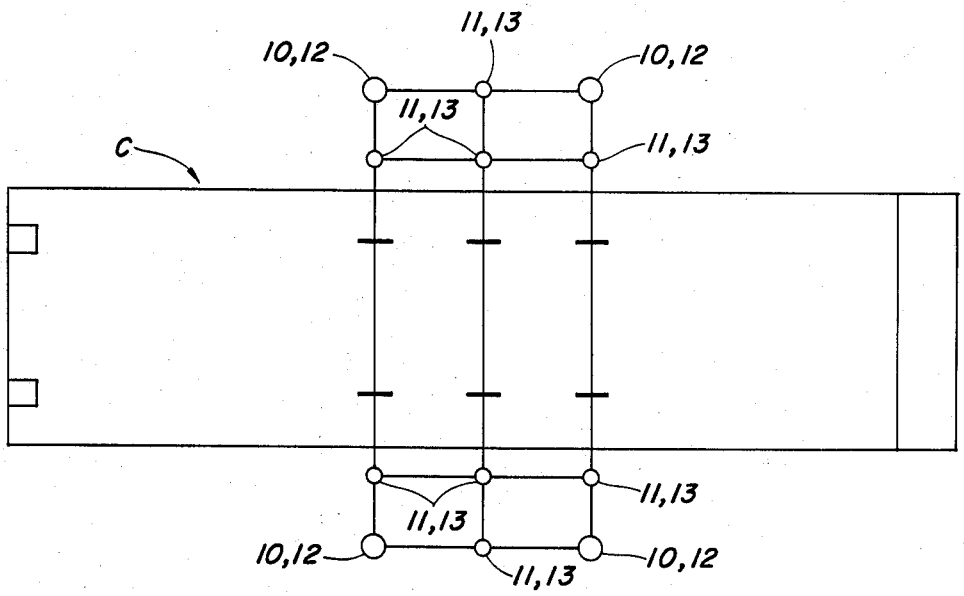
FIG. 2 is a schematic plan view of the arrangement of the mating devices.

Referring first to FIG. 1, a deck portion, which here is a generally rectangular integrated deck of tubular or plate girder steel construction indicated generally by the reference letter A, is arranged to mate onto a base portion, which here is a tubular steel jacket indicated generally by the reference letter B, to form a platform. The deck has twelve legs, comprising four corner legs 10 and eight inner legs 11 (see FIG. 2), the lower end of each of which is arranged to abut end-to-end with a respective corner or inner leg 12, 13 of the jacket. Many other possible arrangements of legs may be envisaged, for example eight legs in two groups of four, or sixteen in two groups of eight.

Referring now to FIGS. 3 to 5 and 10, within each of the deck legs 10 and 11 is a stabbing pin indicated generally by the reference numeral 14, comprising a cylindrical body 15 with a convex conical bottom end cap 16 and with an outwardly extending flange 17 at its upper end. A stop collar 18 secured to the inside of the deck leg 10 encircles the cylinder 15 near the bottom end of the deck leg. A bearing 19 fixed to the flange 17 slidably engages the inner surface of the deck leg 10. Bearings 20 and 21 fixed to the stop collar 18 and a secondary mating cone 22, respectively, slidably engage the cylinder 15. The bearings 19 to 21 permit the stabbing pin 14 to move axially while maintaining it co-axial with the deck leg 10,11. The bearings 19 to 21 are plain bearings. Collar 18 and secondary mating cone 22 may each be provided with a plurality (six or eight) of equally spaced reinforcing fins 18' and 22', respectively.

Figure 3:
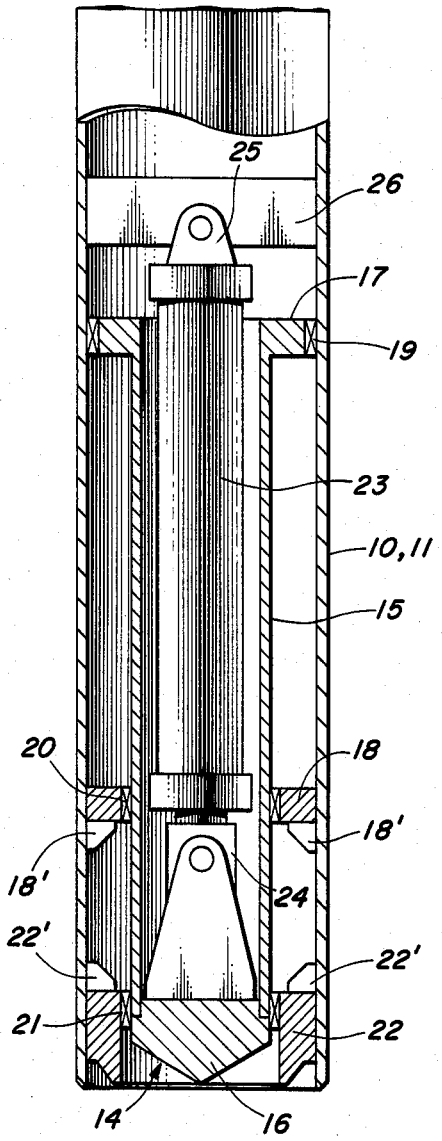
FIG. 3 is an axial cross-sectional view of the stabbing member, and associated parts, of a first mating device.
Figure 4:
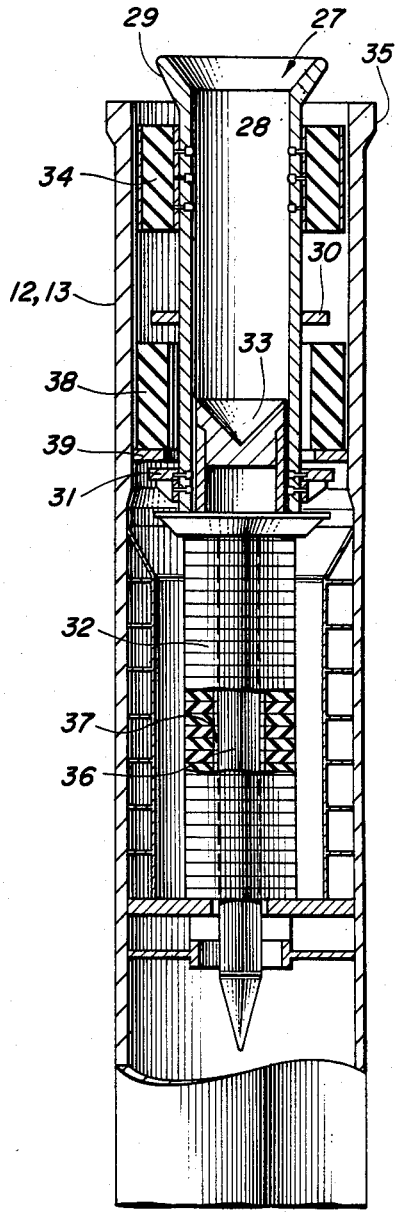
FIG. 4 is an axial cross-sectional view of the capture member, and associated parts, of the said first mating device.

A hydraulic ram 23 is connected at its lower end to a bracket 24 on the top of the cylindrical body 15 and at its upper end to a bracket 25 on a crossbar 26 fixed within the deck leg 10. When the hydraulic ram 23 is fully retracted, as shown in FIG. 3, the conical cap 16 is at the level of the bottom end of the deck leg. The cylinder of the hydraulic ram 23 is attached to the crossbar 26 and the piston rod is attached to the stabbing pin 14. The hydraulic ram 23 is connected by pipes (not shown) to a source of hydraulic power (not shown).

Within the jacket legs 12 and 13 (FIG. 4) is a capture member indicated generally by the reference numeral 27 that comprises a cylindrical tube 28, the internal diameter of which is somewhat larger than the external diameter of the stabbing pin 14. At the upper end of the tube 28 the capture member 27 spreads out to form a concave secondary capture cone 29, the extreme diameter of the funnel being somewhat less than the internal diameter of the legs 10–13. Two flanges 30 and 31 extend outwardly from the tube 28. The capture member 27 stands on, but is not secured to, the top end of resilient means in the form of a spring stack 32. Throughout the specification when the terms "resilient" and "resiliency" are used, it will be understood that the important characteristic being described is the ability of the material to elastically deform thereby dampening motion. The spring stack 32 is long compared with the stroke of the ram 23, and is preferably made of elastomeric material with spacers so that it can deform and be compressed axially fairly easily. As shown, the spring stack 32 comprises a stack of separate elastomeric members which may each be of generally annular form. These elastomeric members are maintained in alignment by guide pin 36 which passes through a central aperture 37 in each member.

Figure 5:
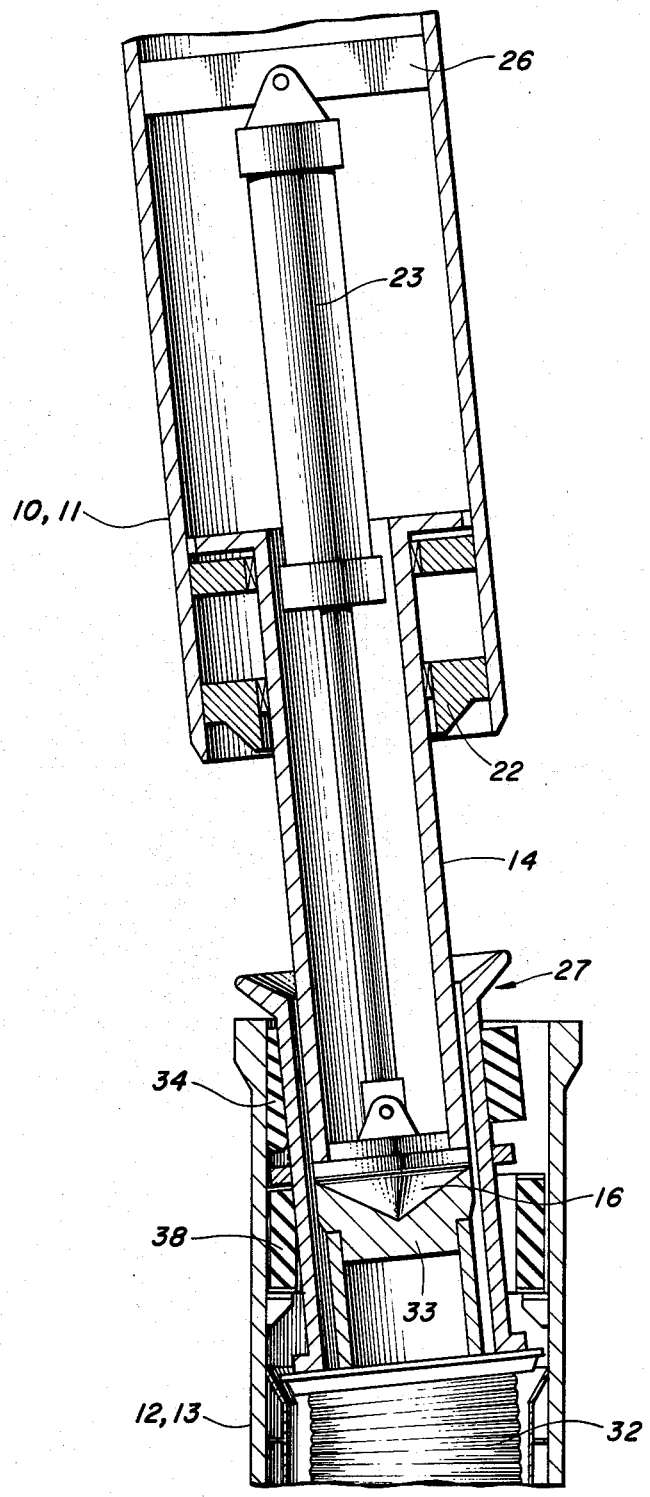
FIG. 5 is an axial cross-sectional view of the said first mating device with its stabbing member and capture member interengaged when the said deck and base portions are misaligned.
Figure 6:
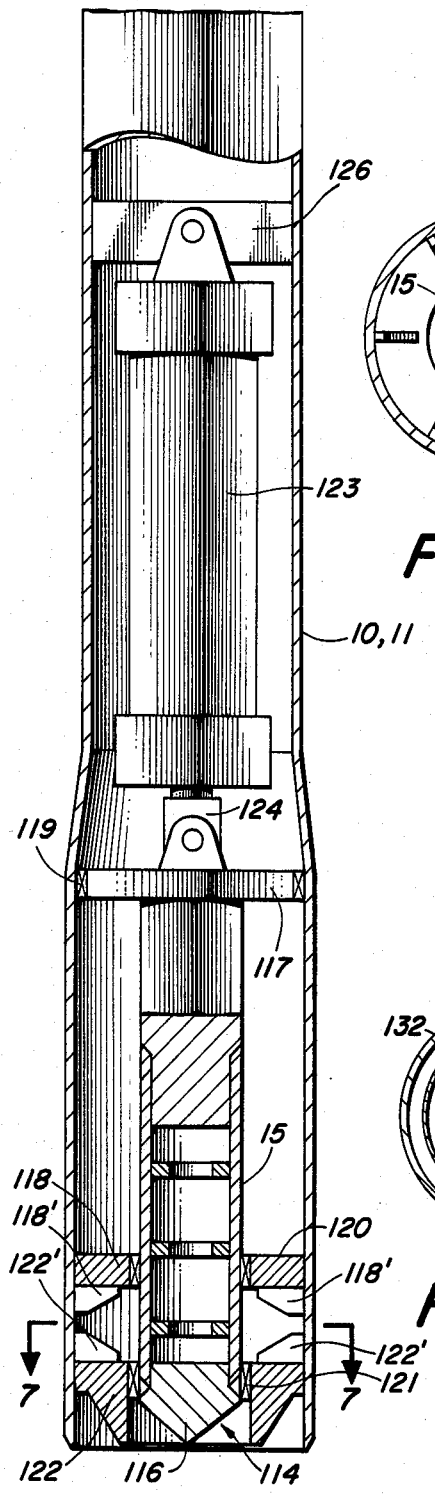
FIG. 6 is an axial cross-sectional view of the stabbing member, and associated parts, of a second mating device.
Figure 7:
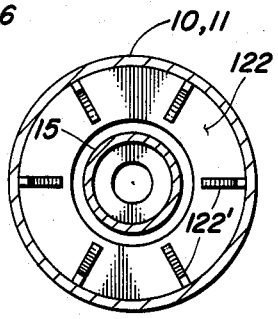
FIG. 7 is a lateral cross-sectional view as seen along line 7—7 in FIG. 6.
Figure 9:
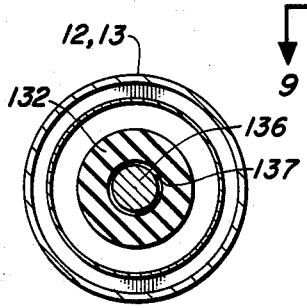
FIG. 9 is a lateral cross-sectional view as seen along line 9—9 in FIG. 8.
Figure 8:
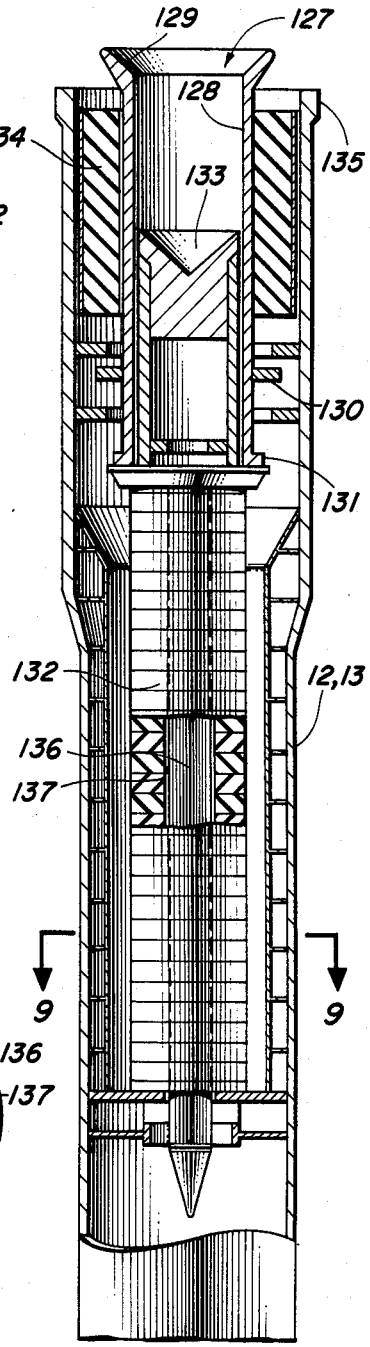
FIG. 8 is an axial cross-sectional view of the capture member, and associated parts, of the said second mating device.
Figure 11:
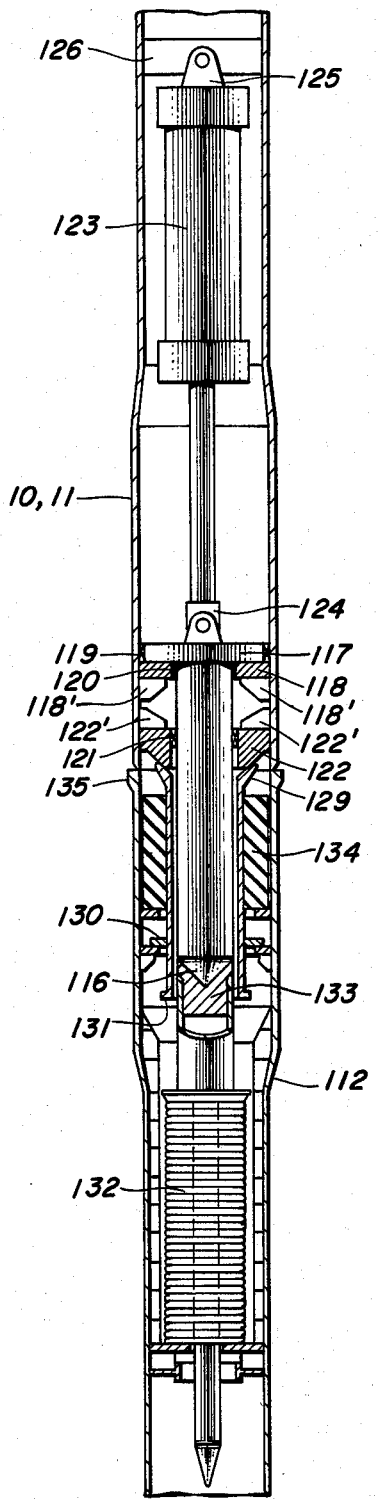

Within the capture member 27, a concave primary capture cone 33 stands on, and is preferably secured to, the top of the spring stack 32. The tube 28 is encircled at its upper part by a resilient thrust bearing 34 in the form of a collar of elastomeric material which may be secured either to the outside of the tube 28 or to the inside of legs 12 and 13. The resilient bearing 34 may be stiffened by one or more metal tubes embedded in the elastomer. The resilient bearing 34 serves mainly to stabilize the capture member 27 against radial displacement and tilting (FIG. 5). There is a thickened rim 35 around the upper end of the jacket legs 12 and 13. An annular second spring 38 in the form of a sleeve of elastomeric material encircles the tube 28 below flange 30 and is supported by flange 39 on the inside of jacket legs 12 and 13. The second spring 38 is much stiffer than the first spring 32, and may have metal disc annuli embedded in it to increase its stiffness.

The operation of this first embodiment of the mating device is as follows:

The jacket B is installed at a desired location and may be either standing on the bottom or may be a floating jacket that is moored to the ocean floor by tension legs, or the like. Then the deck A is maneuvered over the jacket while being supported by a barge C, or the like. The deck is so positioned that each leg 10, 11 is approximately coaxial with its respective jacket leg 12, 13, with the conical cap 16 of the stabbing pin 14 separated from the primary capture cone 33 by a distance slightly shorter than the stroke of the ram 23. The ram 23 is fully retracted as shown in FIG. 3. It will be appreciated, however, that because of the action of wind and waves, it will not normally be possible to align the deck legs 10 and 11 and the jacket legs 12 and 13 exactly, except transiently.

The ram 23 is then actuated extending the stabbing pin 14. This may be done quickly when legs 10 and 11 are sufficiently closely aligned with legs 12 and 13, respectively. The extension of a plurality of stabbing pins 14 may occur separately as when the opportunity arises; however, it is preferred to extend all of the stabbing pins simultaneously. The conical cap 16 either enters the capture member 27 directly or, is guided into it by the secondary capture cone 29 and then seats in the primary capture cone 33. The stabbing pin 14 is kept coaxial with leg 10 or 11 by the bearings 19 to 21. The stabbing pin preferably pushes down the primary capture cone 33 and compresses the first spring 32 slightly so that the cap 16 and cone 33 will remain in engagement even if the large C carrying the deck A is lifted by a wave. Due to the configuration of the leg mating system of the present invention, a significant misalignment (5°) can be tolerated without disengagement of stabbing pin 14 and cone 33 (FIG. 5). The cylindrical thrust bearing 34 will tend to realign capture member 27 and the stabbing pin 14 with the longitudinal axis of base leg 12,13.

The deck is then lowered, by ballasting the barge for example, while keeping ram 23 extended. Part of the weight of the deck is then transmitted from legs 10, 11 through ram 23 to primary capture cone 33 to the first spring 32, which is thereby compressed and the engagement of the stabbing pin 14 with the capture cone 33 keeps the legs 10, 11 approximately aligned with 12 and 13. The process continues in this manner, with the pressure exerted through the ram 23 gradually increasing until the secondary mating cone 22 engages and seats on the secondary capture cone 29, which is supported by the second spring 38 abutting flange 30 (i.e., the capture member 27 no longer stands on the first spring 32 as a result of the spring's compression by stabbing pin 14). Because first spring 32 is both long and comparatively soft, only a minor portion of the weight of the deck is ever carried by the rams 23.

Figure 10:
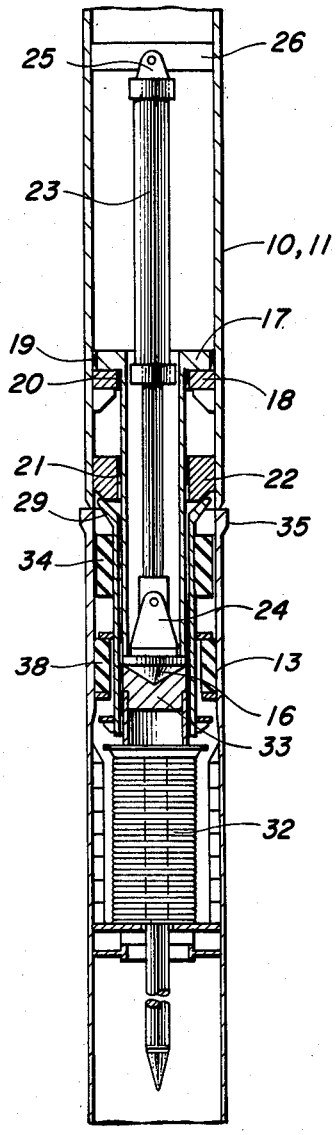
FIG. 10 is an axial cross-sectional view of the said first mating device with its stabbing member and capture member interengaged; and, FIG. 11 is an axial cross-sectional view of the said second mating device with its stabbing member and capture member interengaged.

As the lowering of the deck continues, weight will be transferred from the deck legs 10, 11 through the secondary mating cone 22 and the capture member 27 to the second spring 38. The secondary mating cone 22 and the capture member 27 will maintain a closer alignment of legs 10, 11 and 12, 13 than stabbing pin 14 and the primary capture cone 33. Because of the stiffness of the springs 38, they rapidly take a substantial portion of the weight of the deck A, with the result that fluctuations in the upthrust on the barge caused by the waves, and the like, are absorbed with only small movements of the legs 10, 11 and eventually, the bottoms of deck legs 10,11 seat on the tops of the jacket legs 12 and 13 in a controlled manner and with sufficiently accurate alignment. A small misalignment of the axes of the deck legs 10,11 and jacket legs 12,13 can be accomodated due to the thickness of the rims 35 on which the deck legs seat. Because the second spring acts between legs 10,11 and 12,13 by way only of secondary mating cone 22, capture member 27, and the flange 39, the ram 23 is never subjected to the full load on the second spring (FIG. 10).

The legs 10,11 and 12,13 can now be welded together and it may then be possible to dismantle the mating device and to remove at least part of it from inside the leg.

In the alternate embodiment depicted in FIGS. 6 through 9 and 11, the second spring 38 is omitted from the leg mating devices. Rather, structurally similar sets of mating devices are placed in base legs 12 and 13, with the set of devices in legs 13 having the stronger springs (i.e., containing elastomeric discs with a larger spring rate). Parts of the apparatus shown in FIGS. 7 and 8 which are similar in structure or function to corresponding parts in FIGS. 3 to 6 are given the same reference numerals with 100 added and will not be described again.

The operation of the second embodiment of the mating device is as follows:

The deck is so positioned that each deck corner leg 10 is approximately coaxial with its respective jacket corner leg 12, with the conical cap 116 of the stabbing pin 114 separated from the primary capture cone 133 by a distance slightly shorter than the stroke of the ram 123 as was done in the first embodiment.

The rams 123 of two diagonally opposite corner legs are extended, extending the stabbing pin 114 into engagement with primary capture cones 133. Then, the same procedure is followed with the other two corners.

Once all four corner sets of leg mating devices are engaged, the mating devices of the inner leg combinations 11 and 13 are brought into operation. These mating devices are identical in all essential respects to those of the corner legs 10 and 12, with the exceptions that the spring stacks 132 of the jacket inner legs 13 are of a substantially larger spring rate than the spring stacks 132 of the corner legs, those stacks are shorter, and the primary capture cone 133 is omitted from the mating devices of legs 13. As a result of these changes, none of the load is transmitted from legs 11 to legs 13 through rams 123. Stabbing pins 114 function only as alignment devices. The entire loading of the spring stacks of legs 13 is accomplished by cone 122 engaging capture member 127.

When the mating devices of all of the inner leg combinations 11, 13 have been operated, the deck is now lowered by ballasting the barge C, while keeping all of the rams 123 extended. Part of the weight of the deck is now transmitted from the legs 10 through the rams 123 and the primary capture cones 133 to the spring stacks 132, which are compressed, and the engagement of the stabbing pins 114 with the capture cones keeps the legs 10 and 12, approximately aligned. At this time, however, there is no compression of the spring stacks 132 in the legs 13, as their stabbings pins 114 have not yet engaged them. Lowering continues in this fashion, with the force in the rams 123 gradually increasing, until about 30 percent of the deck weight has been transferred.

When about 30 percent of the weight of the deck has thus been taken up by way of the mating devices in the corner legs, the secondary mating cone 122 in the inner legs 13 engage the capture member 127 compressing spring stacks 132 and the next about 20 percent of the load transfer is taken up by the stiffer spring stacks 132. At approximately 50 percent of load transfer the mating surfaces of the leg tubulars make contact. Ballasting then continues with no relative motion between the deck and the jacket until about 80 percent of the deck weight has been transferred, whereafter the barge is separated from the deck by the actuation of drop blocks on the barge which do not form part of the present invention. The leg tubulars may now be welded together to complete the operation of assembling the deck and jacket.

Further details of the structure of the spring stacks 132 and the resilient bearings 134, in a typical case, for this second embodiment, are as follows.

The spring stack 132 for the corner legs is manufactured as a series of standard rubber layer elements, each incorporating steel plate reinforcement to form a stack height of 6.47 m. The steel plate is arranged to operate as an internal bearing around a central guide pin, and provide clearance to avoid rubber bulging inwards and binding on the guide pin. The rubber is bonded to the reinforcement during vulcanization, which would be carried out in a large flat bed press. Shaping is included both on the internal and external diameters to minimize bulging and maximize tear resistance. Proposed sizes for the spring stack 132 are 104 elements 1250 mm OD, 525 mm ID with a rubber thickness of 58 mm to provide a total stack height of 6.47 m and axial stiffness of 1250 Tonne/m. The specification is as follows:

Size: 1.25 m OD×0.52 m ID
Height: 6.47 m (104 elements×0.058 m, excluding reinforcements)
Material: Natural Rubber 60 IRHD±2
Stiffness: 1250 Te/m
Deflection: 1.9 m (maximum)
Strain: 0.30 maximum
Stress: 24 $MN/m^2$
Shape Factor: 3.125

The spring stack 132 for the intermediate legs would utilize similar elements as specified for the stack 132 for the corner legs and operate under similar conditions. Proposed sizes for the stack 132 consist of 61 elements 1250 mm OD, 525 mm ID with a rubber thickness of 58 mm to provide a total stack height of 3.9 m and axial stiffness of 2125 Tonne/m. The specification is as follows:

Size: 1.25 m OD×0.52 m ID
Height: 3.9 m (61 elements×0.058 m, excluding reinforcements)
Material: Natural Rubber 60 IRHD±2
Stiffness: 2125 Te/m
Deflection: 0.25 m (maximum)
Strain: 0.07 maximum
Stress: 5.16 $MN/n^2$
Shape Factor: 3.125

The resilient bearing 134 for the corner legs is manufactured as a set of four complete rings, stacked vertically. Each ring element is 2.2 m OD and 0.5 m high. Moulding is in an antoclave, the elastomer rings being bonded to a back flange for attachment to the capture cone body. The lateral stiffness of the assembly is 12500 Tonne/m. The bearings for the corner legs 134 are, designed to accommodate 0.2 m of lateral deflection and form an integral part of the total composite lateral stiffness of the jacket leg ends. This feature minimizes overloading of the jacket leg, the bearing deflection being limited by external stops on the capture cone body. The specification is as follows:

Size: 2.2 m OD×1.3 m ID
Height: 2.0 m (4 elements×0.5 m)
Material: Natural Rubber 75 IRHD±2
Stiffness: 12500 Te/m
Deflection: 0.2 m (maximum)
Strain: 0.44

The requirements for resilient bearing 134 for the intermediate legs are similar to, but much less severe than, those specified for the corner legs, since most of the lateral support is handled by the latter bearings. The specification is as follows:

Size: 1.9 m×1.3 m ID
Height: 1.0 m (2 elements×0.5 m)
Material: Natural Rubber 75 IRHD±2
Stiffness: 12500 Te/m
Deflection: 0.034 m
Strain: 0.10

The characteristics of the materials used in the first spring and the resilient bushing of the first embodiment are similar to those set forth above. The second spring is much shorter in this embodiment than in the second and, hence, requires a higher spring rate, which, as suggested earlier, can be achieved by interspersing steel plates in the resilient material. It is to be clearly understood that there are no particular features of the foregoing specification, or of any claims appended hereto, which are at present regarded as being essential to the performance of the present invention, and that any one or more of such features of combinations thereof may therefore be included in, added to, omitted from or deleted from any of such claims if and when amended during the prosecution of this application or in the filing or prosecution of any divisional application based thereon.

Various changes, alternatives and modifications will become apparent to a person of ordinary skill following a reading of the foregoing specification. It is intended that all such changes, alternatives and modifications as come within the scope of the appended claims be considered a part of the present invention.

We claim:

1. An offshore platform having a leg mating system useful in aligning a first end of a leg from a deck portion with a first end of a leg of a previously installed base portion of said offshore platform, said leg mating system comprising extendable stabbing pin means having first end means fixedly secured within one of said deck or base portion legs, second end means of said stabbing pin means being extendable beyond said first end of said deck or base portion leg, capture member means positioned within the other of said deck or base portion legs for receiving said stabbing pin means, first resilient spring means having a first spring rate associated with said capture member means, second resilient spring means having a second spring rate greater than said first spring rate, said second spring means also being associated with said capture memeber means, said first and second spring means being operative in that order upon engagement of said stabbing pin means of said leg mating system with said capture member means to produce a resilient opposition to the coupling of said deck portion with said base portion, the composite spring rate of said first and second spring means increasing as the separation between said deck portion and said base portion decreases.

2. The offshore platform of claim 1 wherein said second end of said stabbing pin means is extended beyond said first end of said deck or base portion leg by a hydraulic ram.

3. The offshore platform of claim 1 wherein the second, distal end portion of said stabbing pin means and a corresponding end portion of said capture member are shaped to produce a self-centering action.

4. The offshore platform of claim 1 further comprising a resilient thrust bearing surrounding said capture member means and tending to realign said capture member means with the axis of said base portion leg when engaged by said stabbing pin means.

5. The offshore platform of claim 1 wherein each of said deck portion has a plurality of legs and more than one of said deck and base portions' legs is equipped with said stabbing pin means and said capture member means of said leg mating system.

6. The offshore platform of claim 5 wherein each of said deck and base portions' legs contain either a stabbing pin means or a capture member means of said leg mating system.

7. The offshore platform of claim 6 wherein each capture member means of said leg mating system includes both said first and said second resilient spring means.

8. The offshore platform of claim 7, wherein the force compressing said second resilient spring means is transmitted between the deck portion and the base portion without passing through said stabbing pin means.

9. The offshore platform of claim 7 wherein said first and second spring means each comprise a stack of annular resilient members.

10. The offshore platform of claim 9 wherein the annular resilient members of said first spring means are maintained in alignment by a guide pin which passes through a central aperture in each said member.

11. The offshore platform of claim 10 wherein said capture member means comprises a primary capture cone which sits upon and is attached to the top of the stack of resilient members comprising said first spring means.

12. The offshore platform of claim 11 wherein a secondary capture cone encircles, but is not attached to, said primary capture cone.

13. The offshore platform of claim 12 wherein said secondary capture cone sits upon, but is not attached to the top of the stack of resilient members comprising said first spring means.

14. The offshore platform of claim 13 wherein said second spring means encircles, but is not attached to, said secondary capture cone.

15. The offshore platform of claim 6 wherein the corner legs of said deck and base portions contain a leg mating system employing said first spring means and the remaining legs contain a leg mating system employing said second spring means.

16. A method of assembling an offshore platform by mating a deck portion to a previously installed base portion, said method comprising extending stabbing pin means from one of the deck and base portions to engage capture member means resiliently mounted on the other of portions, said deck and base portions, reducing the separation between the deck portion and the base portion, resisting the reduction of said separation by a first resilient spring means having a first spring rate, said first spring means becoming operative as soon as said stabbing pin means engages said capture member means, and subsequently resisting said separation by a second resilient spring means with a second spring rate higher than said first spring rate, the combined spring rate of said first and second resilient means increasing as the separation decreases.

17. A method of assembling an offshore platform as in claim 16 wherein said deck portion has a plurality of legs and said base portion has a corresponding plurality of legs which, with the plurality fo deck legs, form a plurality of sets of legs including corner leg sets and intermediate leg sets each of which sets contain a leg mating system comprised of a stabbing pin means and a capture member means and said mating is accomplished by extending all of said stabbing pin means.

18. A method of assembling an offshore platform as in claim 17 wherein the stabbing pin means of a first pair of diametrically opposed corner leg sets are initially extended and engaged with their respective capture member means.

19. A method of assembling an offshore platform as in claim 18 wherein a second or other pair of diametrically opposed corner leg stabbing pin means are extended and engaged with their respective capture member means prior to the activation of the stabbing pin means of the intermediate leg sets.

20. A method of assembling an offshore platform as in claim 18 wherein said first spring means with said first spring rate are contained in said corner sets of legs and said second spring means with said second spring rate are contained in the intermediate sets of legs, said first spring means being substantially fully compressed prior to engagement of the stabbing pin means of said sets of intermediate legs with the capture member means of said sets of intermediate legs.

* * * * *

UNITED STATES PATENT AND TRADEMARK OFFICE

CERTIFICATE OF CORRECTION

PATENT NO. : 4,662,788

DATED : May 5, 1987

INVENTOR(S) : Dean A. Kypke et al.

It is certified that error appears in the above-identified patent and that said Letters Patent are hereby corrected as shown below:

Column 9, line 9, after "said deck portion", insert --and said base portion--.

Column 10, line 22, "fo" should be --of--.

Signed and Sealed this

First Day of September, 1987

*Attest:*

*Attesting Officer*

DONALD J. QUIGG

*Commissioner of Patents and Trademarks*